United States Patent [19]

Willoughby

[11] Patent Number: 4,759,483

[45] Date of Patent: Jul. 26, 1988

[54] BELT LOOP ATTACHMENT FOR A WEAPON CASE

[76] Inventor: Fred M. Willoughby, 3901 Summercrest Dr., Fort Worth, Tex. 76109

[21] Appl. No.: 58,855

[22] Filed: Jun. 5, 1987

[51] Int. Cl.[4] ..... A45F 5/00

[52] U.S. Cl. ..... 224/253; 224/232; 224/240; 224/911

[58] Field of Search ..... 224/250, 907, 911, 912, 224/253, 198, 197, 232, 233, 234, 240, 904, 238

[56] References Cited

U.S. PATENT DOCUMENTS 2,410,640 11/1946 Engle ..... 224/198
2,917,213 12/1959 Bucheimer ..... 224/911 X
2,954,909 10/1960 Miller et al. ..... 224/907 X
3,107,833 10/1963 Vaughn ..... 224/197

*Primary Examiner*—Henry K. Artis
*Assistant Examiner*—David Voorhees
*Attorney, Agent, or Firm*—James E. Bradley

[57] ABSTRACT

A retainer for a knife sheath or pistol holster allows the weapon to be positioned at various positions relative to the strap. The retainer is fastened at its top and bottom to the weapon case by fasteners which leave spaces between the top and bottom. Sockets are secured to the case and face toward the retainer. The sockets are located between the fasteners at the top and bottom. Holes extend through the retainer. Pins insert through holes into the sockets. The pins may be selectively removed from the sockets to change the path or loop for the belt.

11 Claims, 4 Drawing Sheets

BELT LOOP ATTACHMENT FOR A WEAPON CASE

BACKGROUND OF THE INVENTION

1. Field of the Invention

This invention relates in general to weapon cases such as holsters or sheaths, and in particular to a belt loop attachment.

2. Description of the Prior Art

Holsters for pistols have been used for many years. A typical holster has a loop on its inward side that receives a belt to allow the user to wear the holster. Some people like to wear the pistol high relative to the belt. Others prefer the pistol low relative to the belt. Some prefer that the pistol incline forward, and others prefer that the pistol that incline rearward relative to the belt.

The belt loop in the art known to applicant is normally fixed in position by stitching or brads. If the loop is secured so that the pistol is carried low, no variance is allowed. The user would need another type of holster to wear it high relative to the belt. Similarly, the only manner in which the holsters are made to incline forward or rearward is by securing the belt loop at inclinations relative to the case. Once secured, it cannot be varied from that position.

Such is also the case with knife sheaths. Normally, the sheath will have a loop attached parallel with the sheath for carrying it perpendicular to the belt. This type of loop does not allow the user to incline the knife forward relative to the belt. Nor would it allow the user to place the knife on a belt with a sheath parallel with the belt, such as when wearing a strap or belt extending over the shoulder of the user.

Also, the sheaths and holsters known to applicant are of a fixed loop dimension. If the belt is smaller than the loop dimension, the holster or sheath will be loose on the belt. The belts of various dimensions do not tightly fit in the standard loop because it is made for only one size.

SUMMARY OF THE INVENTION

In this invention, the belt loop or retainer is secured in a fixed position relative to the weapon case. The retainer has a greater clearance length than the width of the belt by a significant amount. Between the upper and lower ends, a number of holes are formed in the retainer. Each hole in the retainer aligns with a socket located on the inward side of the weapon case. Threaded pins, or screws, are inserted through these holes into the sockets.

By choosing the holes into which these screws are inserted, the user can define a loop of wider or narrow width. The user can define a loop that is lower or higher relative to the holster or sheath. The user can also define an angled loop that inclines the holster or sheath relative to the belt.

DESCRIPTION OF THE PREFERRED EMBODIMENT

Figure 1:
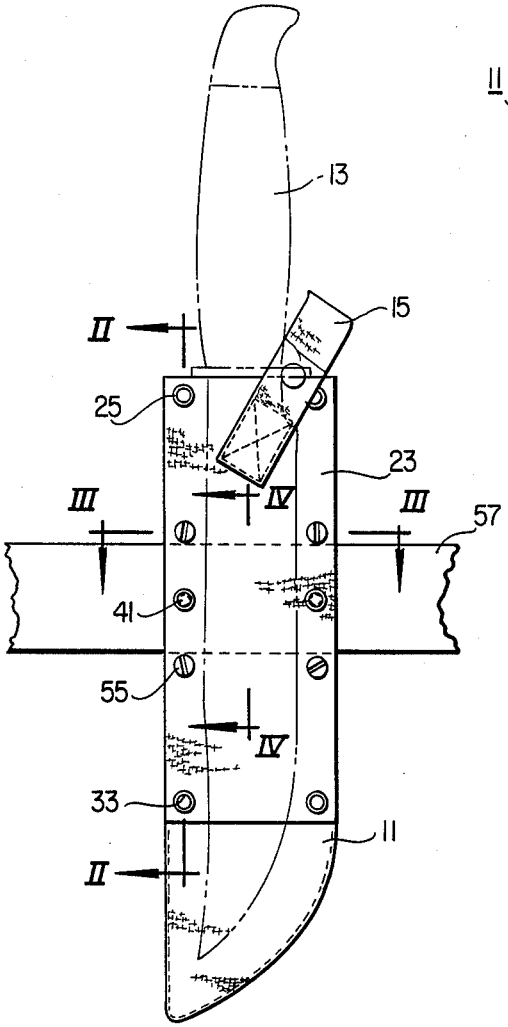
FIG. 1 is a side view of a knife sheath constructed in accordance with this invention.
Figure 3:
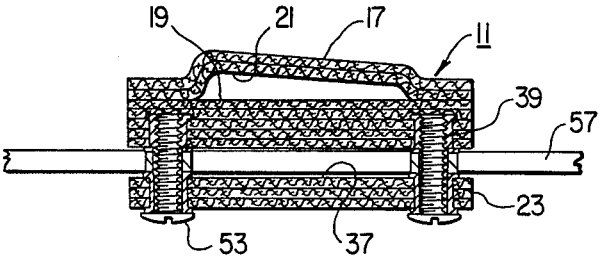
FIG. 3 is a sectional view of the sheath of FIG. 1, taken along the line III—III.
Figure 4:
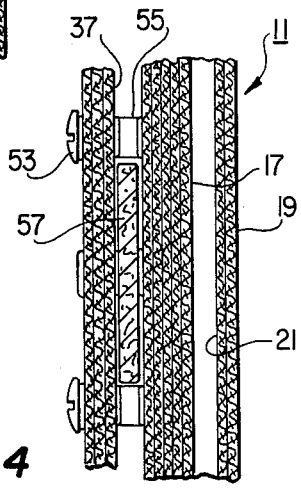
FIG. 4 is a sectional view of the sheath of FIG. 1, taken along the line IV—IV.

Referring to FIG. 1, a case or sheath 11 is constructed to receive a knife 13. A strap 15 secures the knife 13 in place to prevent its removal unless the strap 15 is unfastened. As shown in FIG. 3, the sheath 11 is of a material, preferably ballistic Nylon or leather, having a multilayer outer piece 17 secured to a multilayer inner piece 19. A receptacle 21 is formed between the inner and outer pieces 17 and 19.

Referring again to FIG. 1, a retainer 23 is located on the inward side of the sheath 11. Retainer 23 is a multilayer flat rectangular piece of material, preferably the same type as used with the sheath 11. Preferably, the width of retainer 23 is the same as the width of the sheath 11. The length of the retainer 23 is about three-fourths the length of the sheath 11 in the embodiment shown in FIG. 1.

Figure 2:
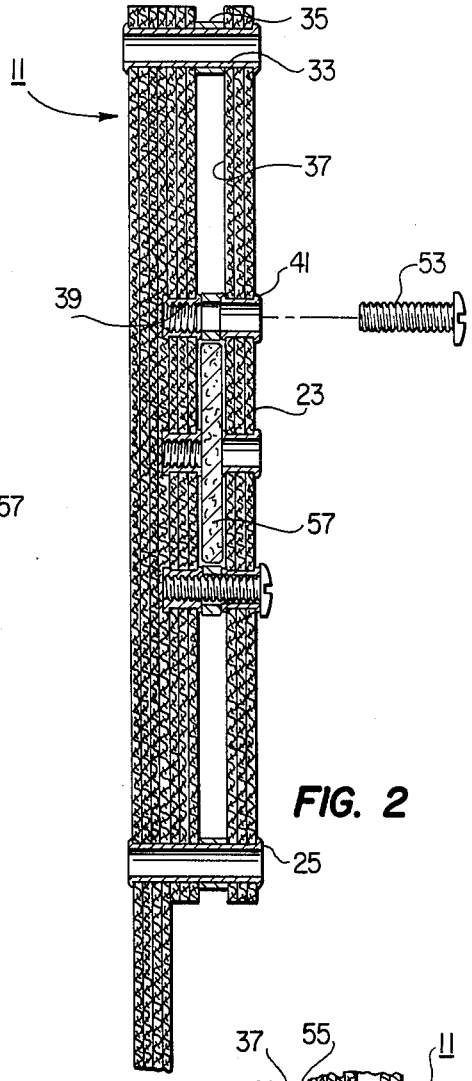
FIG. 2 is a sectional view of the sheath of FIG. 1, taken along the line II—II.

A plurality of fasteners 25 secure the retainer 23 to the sheath 11. One of the fasteners 25 is located in each corner of the retainer 23. The lateral distance between the fasteners 25 is greater than the width of the receptacle 21. As shown in FIG. 2, each of the fasteners 25 is a hollow, rigid member such as a rivet, having a passage 33 therethrough. An annular washer or spacer 35 encircles each fastener 25 betweeen the retainer 23 and the sheath 11. Spacer 35 results in a clearance 37 located between the sheath 11 and retainer 23. Each fastener 25 extends completely through the inner and outer pieces 17, 19 (FIG. 3), permanently fastening the retainer 23 to the sheath 11. A string or thong (not shown) may be inserted through the passage 33 to lash the sheath 11 to the person's body.

Referring to FIGS. 2 and 3, a plurality of sockets 39 are secured in the sheath 11. Each socket 39 extends through the inner piece 17 but not the outer piece 19, as shown in FIG. 3. The distance between the sockets 39 is greater than the width of the receptacle 21. Each socket 39 is internally threaded. One end is flush with the inward surface of the inner piece 19. This end of each socket 39 is spaced from the retainer 23 by a distance equal to the clearance 37.

Figure 5:
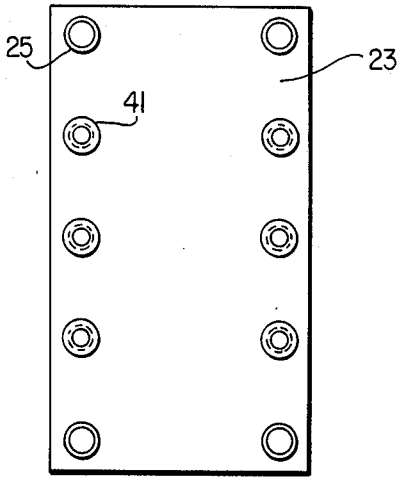
FIG. 5 is a side view of the retainer for the sheath of FIG. 1.

Referring to FIG. 5, six grommets 41 extend through the retainer 23. Each grommet 41 has a passage or hole through it. The grommets 41 include two upper grommets, two middle grommets, and two lower grommets. Three of the grommets 41 are spaced in a vertical line in alignment with the upper and lower fasteners 25 on the left side edge. The other three grommets 41 are spaced in a vertical line in alignment with the upper and lower fasteners 25 on the right side. The upper grommets 41 are located on the same horizontal line perpendicular to the vertical lines. Similarly, the middle and lower grommets 41 are located on horizontal lines parallel to the horizontal line passing through upper grommets 41.

The grommets 41 are equally spaced apart from each other measured vertically. The distance from the upper fasteners 25 to the upper grommets 41 is equal to the distance between upper grommets 41 and lower grommets 41. This is twice the vertical distance between any of the grommets 41. Similarly, the vertical distance from the lower fasteners 25 to the lower grommets 41 is the same distance as the distance from the upper fasteners 25 to the upper grommets 41. The distance from the grommets 41 on the left side to the grommets 41 on the right side is equal to the vertical distance between the upper and lower grommets 41.

Each grommet is positioned in alignment with one of the sockets 39 (FIGS. 2, 3). Each grommet 41 extends only through the retainer 23, and its ends are flush with the inner and outer sides of the retainer, as shown in FIGS. 2 and 3.

Referring to FIG. 2, a threaded pin or screw 53 will pass through each grommet 41 and thread into one of the sockets 39. The screw 53 is inserted through spacer 55, which is a circular member. Spacer 55 has the thickness of the clearance 37 and is retained in place by the screw 53.

In operation, as shown in FIG. 1, a strap or belt 57 is inserted between the retainer 23 and the sheath 11. The distance from the upper to the lower fasteners 25 is considerably greater than the width of the belt 57 to be used, preferably at least twice. If it is desired to carry the sheath 11 in a vertical central position, and if the belt 57 width is approximately the distance between the upper grommets and lower grommets 41, then the position in FIG. 1 will be used. Four screws 53 are inserted. One of the screws 53 is inserted into each upper grommet 41. Also, screws 53 are inserted into each lower grommet 41. The central grommets 41 remain open. The spacers 55 for the central grommets 41 are removed. The screws 53 in the upper grommets 41 and in the lower grommets 41 define the upper and lower boundaries of a loop through which the belt 57 is inserted. A string (not shown) may be inserted through the passages 33 to tie or lash the sheath 11 firmly to the user.

Figure 7:
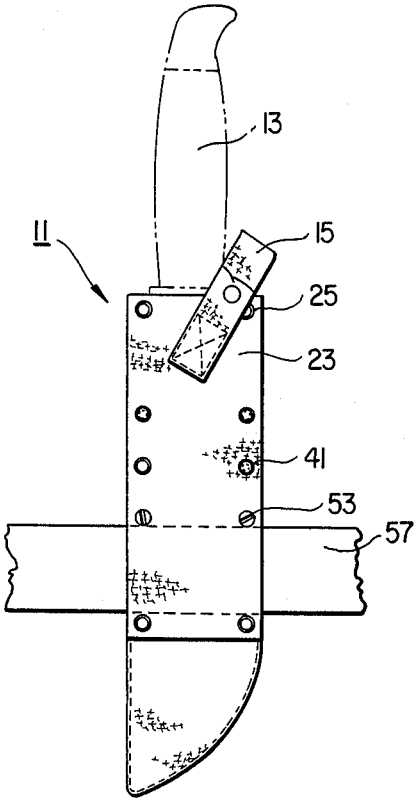
FIG. 7 is a side view of the sheath of FIG. 1, showing the sheath in an upper position relative to the belt.

Referring now to FIG. 7, if the user has the same width of belt 57, but wishes to wear the sheath 11 higher relative to the belt 57, he inserts the belt 57 into the space between the two lower fasteners 25 and the screws in the two lower grommets 41. The screws 53 in the lower grommets 41 and the lower fasteners 25 define the upper and lower boundaries of the loop in this case.

Figure 8:
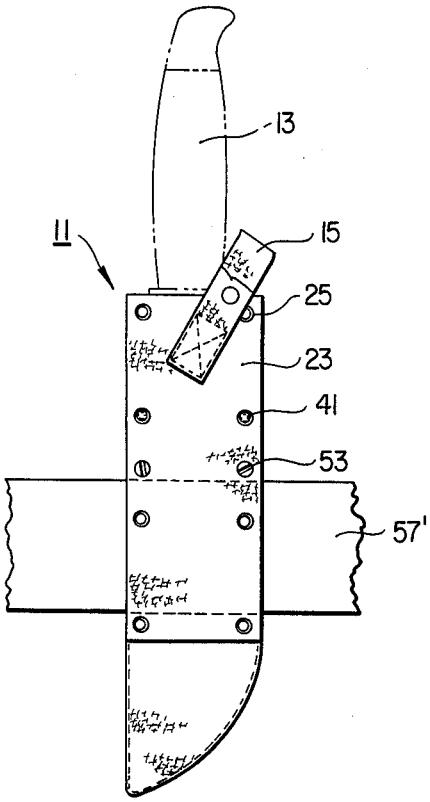
FIG. 8 is a side view of the sheath of FIG. 1, showing a wider belt being used with the sheath than in FIG. 7.

Wider belts 57' may be accommodated by changing position of some of the screws 53. For example, belt 57' shown in FIGS. 8 and 10 has a width that is 50 percent greater than the width of belt 57. If the user wishes to wear belt 57' in a high position, as shown in FIG. 8, the screws 53 in the lower grommets 41 are removed. The loop is now bounded by the lower fasteners 25 and the screws 53 in the middle grommets 41.

Figure 9:
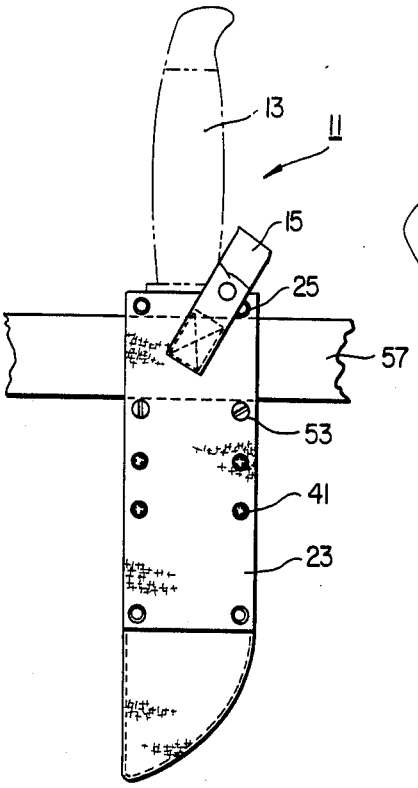
FIG. 9 is a side view of the sheath of FIG. 1, shown in a lower position relative to the belt.

Referring to FIG. 9, if the user has the smaller width belt 57, but wishes to wear the sheath 11 in a lower position relative to belt 57, he inserts the belt 57 between the upper fasteners 25 and the screws 53 in the upper grommets 41.

Figure 10:
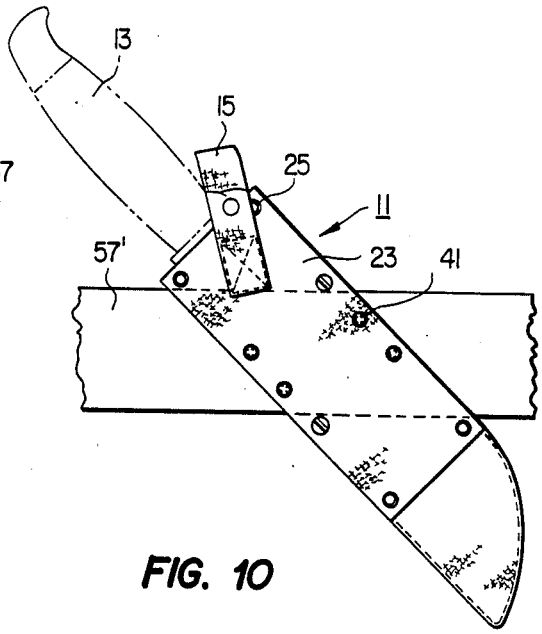
FIG. 10 is a side view of the sheath of FIG. 1, showing this sheath in an inclined position relative to the belt.

Referring to FIG. 10, a 45 degree inclined position is shown. In this position, the wider belt 57' is being used. Screws 53 are removed from the upper and middle grommets 41 on one side edge. Screws 53 are removed from the middle and lower grommets 41 on the other side edge. The diagonal distance between the upper grommet 41 on one side edge and the lower grommet 41 on the other side edge is approximately the width of the belt 57'. This distance is about 50 percent greater than the distance between the upper and lower grommets 41. The sheath 11 will be at a 45 degree inclination in a forward direction relative to the belt 57'.

Figure 11:
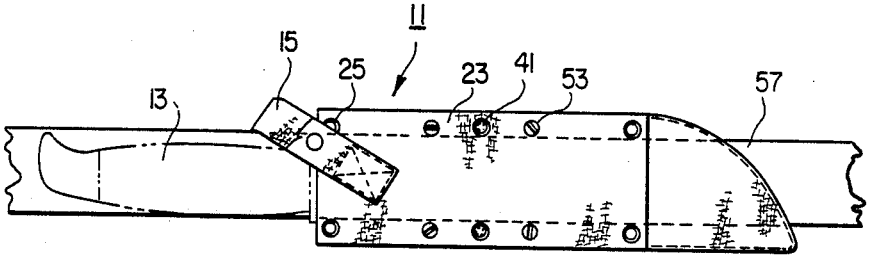
FIG. 11 is a side view of the sheath of FIG. 1, showing the sheath in a parallel position relative to the belt.

In FIG. 11, the belt 57 is inserted longitudinally between the fasteners 25 and grommets 41 on one side edge, and the fasteners 25 and grommets 41 on the other side edge. Screws 53 are positioned in the upper grommets 41 and the lower grommets 41. Although not necessary, screws may be omitted from the middle grommets 41. The sheath 11 is carried parallel to belt 57 in this case.

Figure 6:
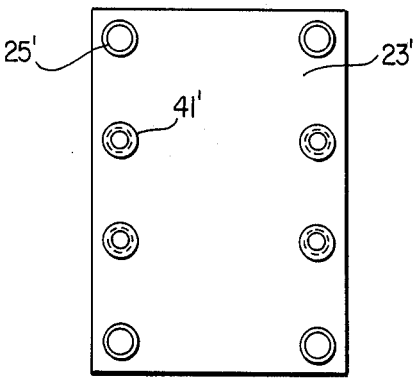
FIG. 6 is a side view of an alternate embodiment for the retainer of FIG. 5.

In FIG. 6, the retainer 23' differs from retainer 23 in that it has only four of the grommets 41', rather than six grommets 41. The fasteners 25' are the same, but are spaced closer together than with retainer 23.

In the embodiment of FIG. 6, a thin belt (not shown) may be inserted between the screws (not shown) in the upper and lower grommets 41'. A wider belt (not shown) may be inserted between the screws in the upper grommets 41' and the lower fasteners 25'. In that case, the screws in the lower grommets 41' would be removed. Similarly, the screws in the upper grommets 41' can be removed, positioning the belt between screws in the lower grommets 41' and the upper fasteners 25'.

Also, the retainer 23' can be secured inclined to the belt. This can be done by removing the screw from the upper grommet 41' on one side edge and the lower grommet 41' on the other side edge. For a forward inclination, similar to that shown in FIG. 10, the inclined loop would be defined by upper fastener 25' on the left side, a screw in the lower grommet 41' on the left side, a screw in the upper grommet 41' on the right side, and the lower fastener 25' on the right side.

In the embodiment of FIGS. 12–15, the invention is used with a holster 61. Holster 61 is a case constructed to receive a pistol 63. A retainer 65, identical to the retainer 23, is secured to the holster 61. Fasteners 67 are located at each corner. Six grommets 69 are spaced in a rectangular pattern on the retainer 65. A plurality of screws 71 are selectively used to define particular loop configurations.

Figure 15:
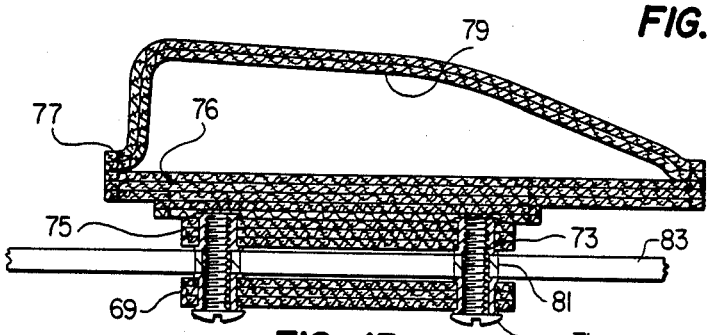
FIG. 15 is a sectional view of the holster of FIG. 12, taken along the line XV—XV of FIG. 12.

Referring to FIG. 15, the sockets 73 are similar to the sockets 39. Each socket 73 is secured in a multilayer support piece 75. The fasteners 67 (FIG. 12) secure the support piece 75 to a multilayer inside piece 76. The inside piece 76 is stitched to the holster 61 with stitches 77 and may be considered part of the holster 61. The fasteners 67 do not extend completely through the holster 61 into the pistol receptacle 79, and they need not be hollow. The head of each fastener 67 locates between the inside piece 76 and the inner side of the holster 61.

Spacers 81 are used around each screw 71 to provide a clearance between the holster 61 and the retainer 65.

Figure 12:
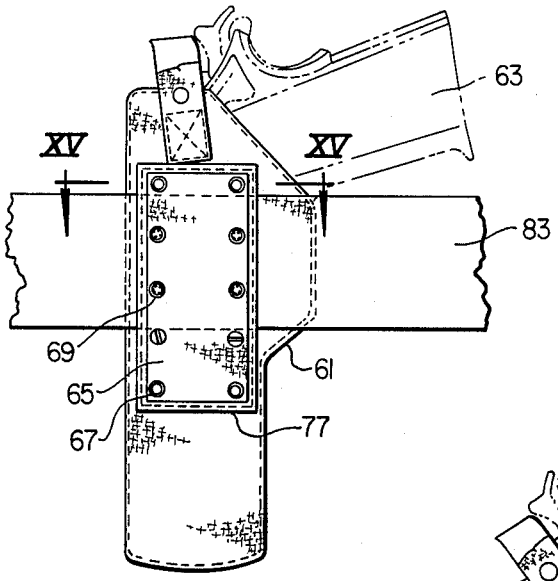
FIG. 12 is a side view of a second alternate embodiment, showing the retainer installed with a pistol holster.

In the operation of the embodiments of FIGS. 12–15, the belt 83 is inserted between the retainer 65 and the holster 61. In FIG. 12, the belt 83 is perpendicular to the retainer 65. The belt 83 is carried between the upper fasteners 67 and the screws 71 in the lowermost grommets 69. The screws 71 in the remaining grommets 69 are removed.

Figure 13:
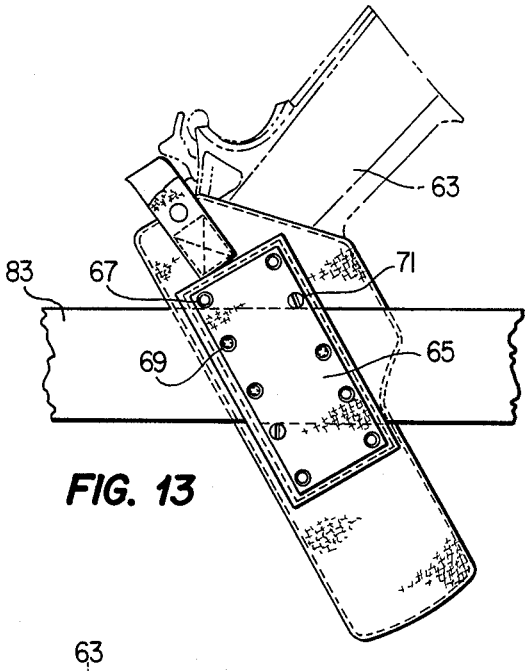
FIG. 13 is a side view of the holster of FIG. 12, shown in an inclined position relative to the belt.

In FIG. 13, a 45 degree forward inclination is provided. On the left side of retainer 65, the belt 83 contacts the upper left fastener 67 and the screw 71 in the lower left grommet 69. On the right side of the retainer 65, the belt 83 contacts the screw 71 in the upper grommet 69 and the lower right fastener 67.

Figure 14:
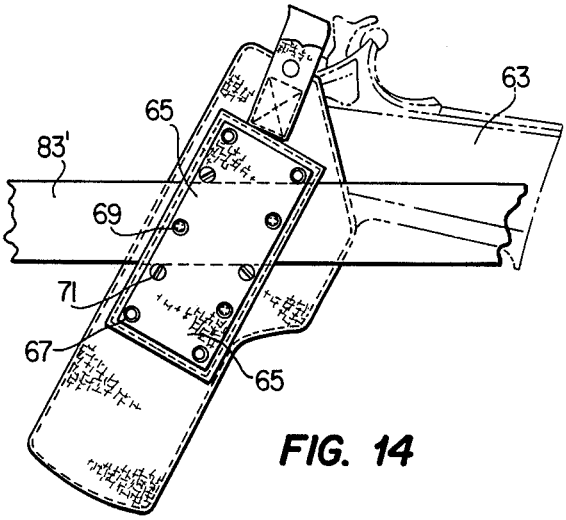
FIG. 14 is a side view of the holster of FIG. 12, showing the holster in an opposite inclined position to that in FIG. 13.

In FIG. 14, a rear 45 degree inclination is achieved. Also, in FIG. 14, the belt 83' is of smaller width than belt 83. The user places screws 71 in the upper left grommet 69, the lower left grommet 69, and the middle right grommet 69. Belt 83' passes through the loop space between the screws 71 in the upper and lower grommets 69 on the left side, and the upper fastener 67 and the screw 71 in the middle grommet 69 on the right side.

The invention has significant advantages. The retainer allows a user to carry an article, such as a weapon, in various positions and with various width belts. By a quick, easy procedure, the user can convert the manner in which the article is carried from a high position, to a low position, to a forward inclination position, and to a rearward position. The retainer accommodates different belt widths. The invention is simple in construction and inexpensive.

While the invention has been shown in only one of its forms, it should be apparent to those skilled in the art, that it is not so limited, but is susceptible to various changes without departing from the scope of the invention.

I claim:

1. An apparatus for carrying an article, such as a weapon, on a strap secured about a person, comprising in combination:

a case having a receptacle for receiving the article;

a retainer having top, bottom and opposing side edges portions;

fastener means for securing the top portion and the bottom portion of the retainer to the case and leaving a space between the retainer and the case extending from the top portion to the bottom portion of the retainer open to allow a strap to be inserted therethrough;

at least four sockets secured to the case and facing toward the retainer, two of the sockets being positioned along one side edge portion of the retainer between the fastening means at the top portion and bottom portion of the retainer, and the other two of the sockets being positioned along the other side edge portion of the retainer between the fastening means at the top portion and bottom portion of the retainer;

a plurality of holes, each extending through the retainer in alignment with one of the sockets; and a plurality of pins releasably inserted through selected holes and secured into selected ones of the sockets to define, in the cooperation with the fastener means, boundaries of a loop for receiving the strap, said sockets and holes being located such that the width, inclination and vertical position of the loop relative to the case is variable by selecting the sockets in which screws are secured.

2. The apparatus according to claim 1 further comprising a spacer adapted to be positioned around each screw between the socket and the hole, to provide a clearance for the loop.

3. An apparatus for carrying an article, such as a weapon, on a strap secured about a person, comprising in combination:

a case having a receptacle for receiving the article;

a retainer having top, bottom, and side edge portions;

two upper and two lower fasteners connecting the retainer to the case in a rectangular pattern such that a lateral space exists between the retainer and the case;

at least two upper and two lower sockets secured to the case and facing toward the retainer, two of the sockets being in a longitudinal row with and between two of the fasteners, and the other two of the sockets being in a longitudinal row with and between the other two of the fasteners;

a plurality of holes, each extending through the retainer, each hole being in alignment with a different one of the sockets;

a plurality of pins releasably inserted through selected holes and secured into selected ones of the sockets, to define in cooperation with the fasteners boundaries of a loop for receiving the strap, the width, inclination and vertical position of the loop relative to the case being variable by selecting the sockets into which the pins are secured; and the lateral space between the upper fasteners, the sockets and the lower fasteners being free of obstructions to allow a strap to be inserted longitudinally between the case and the retainer.

4. The apparatus according to claim 3 wherein each of the fasteners is a hollow tubular member having a passage therethrough for receiving a string for lashing the case to the user.

5. The apparatus according to claim 3 wherein each socket is threaded, and each pin has a threaded end for securing into the socket.

6. The apparatus according to claim 3, further comprising spacer means between the retainer and the case at each fastener and at each socket equipped with a pin, to provide a clearance between the case and retainer for receiving the strap.

7. The apparatus according to claim 3 wherein an inclined loop relative to the case is defined by a lower fastener and a pin within an upper socket on one side edge portion of the retainer, and on the other side edge portion of the retainer by an upper fastener and a pin within a lower socket.

8. A method for carrying an article, such as a weapon, on a strap secured about a person, comprising in combination:

providing a case with a receptacle for the article;

fastening a retainer having a top, bottom, and side portions at its top portion and bottom portion to the case with four fasteners, one upper and one lower on each side edge portion, leaving an open space between the fasteners at the top portion and the bottom portion of the retainer;

securing two upper and two lower sockets to the case, the sockets being located between the upper and lower fasteners and facing the retainer;

forming a plurality of holes through the retainer on each side edge portion and each hole being in alignment with a different one of the sockets;

providing a selected space between the retainer and case by inserting pins through selected ones of the holes and into the mating sockets and leaving other of the sockets free of pins; then inserting the strap through the space.

9. The method according to claim 8, further comprising providing an upper space relative to the case by inserting a pin through two of the holes into the lower sockets and removing the pins from the upper sockets; then inserting the strap between the upper fasteners and the pins in the lower sockets.

10. The method according to claim 8, further comprising providing an inclined space relative to the case by inserting a pin through one of the holes into one of the lower sockets on one side edge portion, and removing the pin from the upper socket on the other side edge portion; then inserting the strap between the upper fastener and the pin in the lower socket on one side edge portion and the lower fastener and the pin in the upper socket on the other side edge portion.

11. The method according to claim 8, further comprising inserting the strap longitudinally between the fasteners and pins within sockets on one side edge portion and the fasteners and pins within sockets on the other side edge portion.

* * * * *